US010324485B2

(12) United States Patent
Huang

(10) Patent No.: US 10,324,485 B2
(45) Date of Patent: Jun. 18, 2019

(54) BODY BIAS VOLTAGE GENERATING CIRCUIT

(71) Applicant: NUVOTON TECHNOLOGY CORPORATION, Hsinchu (TW)

(72) Inventor: Ming-Hsin Huang, Hsinchu (TW)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 15/928,746

(22) Filed: Mar. 22, 2018

(65) Prior Publication Data

US 2018/0335795 A1 Nov. 22, 2018

(30) Foreign Application Priority Data

May 19, 2017 (TW) ..... 106116535 A

(51) Int. Cl.
*G05F 3/02* (2006.01)
*G05F 3/20* (2006.01)

(52) U.S. Cl.
CPC ..... *G05F 3/205* (2013.01)

(58) Field of Classification Search
CPC ..... H03K 2217/0018; H03K 19/0016; G05F 3/205; H02M 3/073; G11C 5/145
See application file for complete search history.

(56) References Cited

U.S. PATENT DOCUMENTS

2009/0243667 A1* 10/2009 Park ..... H03K 19/0027 327/109
2011/0128043 A1* 6/2011 Oh ..... H03K 19/018521 326/87

* cited by examiner

*Primary Examiner* — Long Nguyen
(74) *Attorney, Agent, or Firm* — Muncy, Geissler, Olds & Lowe, P.C.

(57) ABSTRACT

A body bias voltage generating circuit for supplying a body bias voltage to a body of a transistor of a functional circuit is provided, including: a first transistor and a second transistor connected in series between a supply voltage terminal and a ground terminal, wherein a control terminal of the first transistor is coupled with a control terminal of the second transistor; a third transistor, wherein a body of the third transistor is electrically coupled with any one of the body of the first transistor and the second transistor, and a terminal of the third transistor is coupled with the body of the third transistor; and a resistance element coupled between the terminal of the third transistor and a current input terminal of the first transistor or a current output terminal of the second transistor. The terminal of the third transistor is the body bias voltage.

11 Claims, 14 Drawing Sheets

BODY BIAS VOLTAGE GENERATING CIRCUIT

CROSS-REFERENCE TO RELATED APPLICATION

This application claims priority from Taiwan Patent Application No. 106116535, filed on May 19, 2017 at Taiwan Intellectual Property Office, the contents of which are hereby incorporated by reference in their entirety for all purposes.

BACKGROUND OF THE INVENTION

1. Field of the Invention

The present disclosure relates to a body bias voltage generating circuit, in particular, a body bias voltage generating circuit providing an appropriate body bias voltage depending on the change in the voltage of a power supply.

2. Description of the Related Art

Recently, applications of Internet of Things (IOT) are in the limelight, but there are still key techniques to be overcome. For instance, elements adopted in the IOT should have extremely low power consumption, that is, the whole circuit should be able to be turned on when a power supply voltage (VDD) is lower than a standard threshold voltage of a transistor. Hence, what is needed is a body bias voltage generating circuit which enables the whole circuit to be turned on at a lower VDD, and also then restore the circuit to a normal operation condition at the threshold voltage after VDD rises over the threshold voltage, and further prevent from leakage current as much as possible.

SUMMARY OF THE INVENTION

The purpose of the present disclosure is to provide a body bias voltage generating circuit which may provide an appropriate body bias voltage when VDD is lower than the standard threshold voltage of the transistor so that the transistor of a functional circuit may have a reduced threshold voltage for ease of being turned on. When the voltage of the power supply is higher than the threshold voltage of the transistor, the body bias voltage generating circuit of the present disclosure supplies an appropriate body bias voltage to reduce leakage current.

Based on the above purposes, the present disclosure provides a body bias voltage generating circuit for supplying a body bias voltage to a body of a transistor of a functional circuit. The body bias voltage generating circuit comprises a first transistor, a second transistor, a third transistor and a resistance element. The first transistor and the second transistor are connected in series between a supply voltage terminal and a ground terminal. A control terminal of the first transistor is coupled with a control terminal of the second transistor. A body of the third transistor is electrically coupled with one of the bodies of the first transistor and the second transistor. A terminal of the third transistor is coupled with the body of the third transistor. The resistance element is coupled between the terminal of the third transistor and a current input terminal of the first transistor or a current output terminal of the second transistor. The voltage at the terminal of the third transistor is the body bias voltage.

Preferably, the first transistor is an NMOS transistor, the second transistor is a PMOS transistor, and the third transistor is a PMOS transistor. The terminal of the third transistor is a drain electrode. The body of the third transistor is electrically coupled with a body of the second transistor and the drain electrode of the third transistor. A source electrode and a body of the first transistor are coupled with the ground terminal. A source electrode of the second transistor is coupled with the supply voltage terminal.

Preferably, two terminals of the resistance element are each coupled with the drain electrode of the third transistor and the drain electrode of the second transistor.

Preferably, the drain electrode of the third transistor and the drain electrode of the second transistor are electrically coupled. Two terminals of the resistance element are each coupled with the drain electrode of the third transistor and a drain electrode of the first transistor, respectively.

Preferably, the first transistor is an NMOS transistor, the second transistor is a PMOS transistor, and the third transistor is an NMOS transistor. The terminal of the third transistor is a drain electrode. The body of the third transistor is electrically coupled with a body of the first transistor and the drain electrode of the third transistor. A source electrode of the first transistor is coupled with the ground terminal. A source electrode of the second transistor is coupled with the supply voltage terminal.

Preferably, two terminals of the resistance element are each coupled with the drain electrode of the third transistor and a drain electrode of the first transistor, respectively.

Preferably, the drain electrode of the third transistor and a drain electrode of the first transistor are electrically coupled. Two terminals of the resistance element are each coupled with the drain electrode of the third transistor and a drain electrode of the second transistor, respectively.

Preferably, the control terminal of the first transistor and the control terminal of the second terminal receive an enable signal. A control terminal of the third transistor receives an anti-enable signal. The anti-enable signal is an anti-phase signal of the enable signal.

Preferably, the first transistor is an NMOS transistor, the second transistor is a PMOS transistor, and the third transistor is an NMOS transistor. The terminal of the third transistor is a source electrode of an NMOS transistor when the third transistor is an NMOS transistor.

Based on the above purposes, the present disclosure provides a body bias voltage generating circuit for supplying a body bias voltage to a body of a transistor of a functional circuit. The body bias voltage generating circuit includes a first transistor and a second transistor connected in series between a supply voltage terminal and a ground terminal, wherein a control terminal of the first transistor is electrically coupled to a control terminal of the second transistor; a control element comprising a terminal electrically coupled to one of the bodies of the first transistor and the second transistor, and other terminal electrically coupled the supply voltage terminal; and a resistance element electrically coupled between the terminal of the third transistor and a current input terminal of the first transistor or a current output terminal of the second transistor. The voltage at the terminal of the third transistor is the body bias voltage.

Preferably, the control element is a diode comprising a negative electrode electrically coupled to one of the bodies of the first transistor and the second transistor, and a positive electrode electrically coupled to the supply voltage terminal.

Preferably, the control element is a bipolar junction transistor comprising an emitter electrically coupled to one of the bodies of the first transistor and the second transistor, and a collector electrically coupled to the supply voltage terminal, and a base configured to accept an enable signal.

Based on the above purposes, the present disclosure further provides a body bias voltage generating circuit for supplying a body bias voltage to a body of a transistor of a functional circuit. The body bias voltage generating circuit comprises an NMOS transistor, a PMOS transistor, a depletion type NMOS transistor and a resistance element. The NMOS transistor and the PMOS transistor are connected in series between a supply voltage terminal and a ground terminal. A gate electrode of the NMOS transistor is coupled with a gate electrode of the PMOS transistor. A body of the depletion type NMOS transistor is electrically coupled with the body of the NMOS transistor. A source electrode and a body of the depletion type NMOS transistor are electrically connected. A resistance element is coupled between a drain electrode of the depletion type NMOS transistor and a drain electrode of the NMOS transistor. A voltage at the source electrode of the depletion type NMOS transistor is the body bias voltage.

DESCRIPTION OF THE PREFERRED EMBODIMENTS

Here, the implementation of the present disclosure will be described in details in cooperation with appended drawings and embodiments for the ease of realizing how to solve technical problems by applying the technical means and achieve technical effects in the present disclosure.

Before describing the technical features of the present disclosure, the definitions of relevant nouns will be explained first. Hereinafter, the "threshold voltage" of a transistor is a reference value for determining whether a voltage (VGS) between the gate electrode and the source electrode of the transistor is able to turn on the transistor or not. An NMOS transistor is taken as an example, the threshold voltage thereof is a positive value, so when the voltage between the gate electrode and the source electrode of the NMOS transistor is larger than the threshold voltage, the NMOS transistor is turned on. The threshold voltage may be changed depending on the voltage applied on the body of the NMOS transistor. Generally, the body of the NMOS transistor is electrically connected to a source electrode and connected to a power supply or ground, thus the NMOS transistor has a fixed threshold voltage generally.

The body bias voltage generating circuit of the present disclosure is used for supplying a body bias voltage to a body of a transistor of a functional circuit so that the functional circuit is still able to keep a high frequency operation when the voltage of the power supply is too low and in a condition of sub-threshold. The body bias voltage generating circuit comprises a first transistor, a second transistor, a third transistor and a resistance element. The first transistor and the second transistor are connected in series between the voltage supply terminal and the ground terminal GND. The voltage supplied by the voltage supply terminal is labeled as VDD. A control terminal of the first transistor is coupled with a control terminal of the second transistor. The body of the third transistor is electrically coupled with one of the bodies of the first transistor and the second transistor. A terminal of the third transistor is coupled with the body of the third transistor. The resistance element is coupled between the terminal of the third transistor and a current input terminal of the first transistor or a current output terminal of the second transistor. The voltage at the terminal of the third transistor is the body bias voltage.

Various aspects of the present disclosure will be described below by several embodiments.

Figure 1:
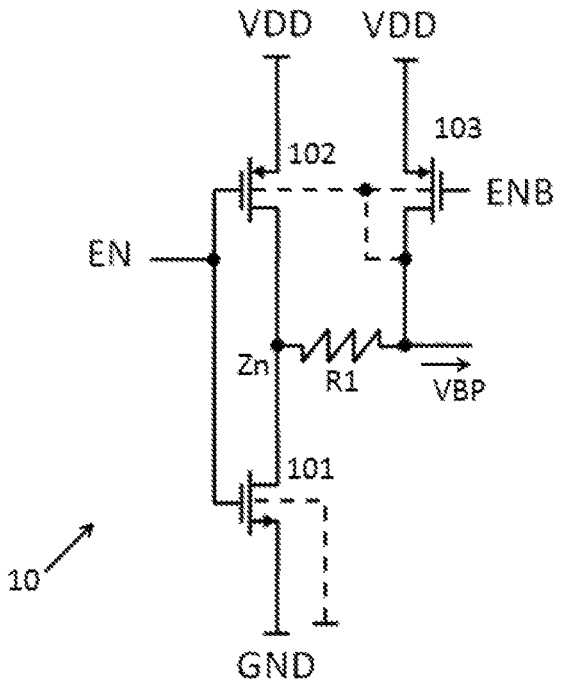
FIG. 1 is a circuit diagram illustrating a first embodiment of the body bias voltage generating circuit of the present disclosure.

Please refer to FIG. 1, which illustrates a circuit diagram of a first embodiment of the body bias voltage generating circuit of the present disclosure. In the figure, transistors comprised in the body bias voltage generating circuit 10 are achieved by metal-oxide-semiconductor field-effect transistor (MOSFET, hereinafter abbreviated as MOS transistor), but this is only an example and the present disclosure is not being limited. The first transistor is an N-type metal-oxide-semiconductor field-effect transistor (hereinafter abbreviated as NMOS transistor) 101, the second transistor is a P-type metal-oxide-semiconductor field-effect transistor (hereinafter abbreviated as PMOS transistor) 102, and the third transistor is a PMOS transistor 103. The body of the PMOS transistor 103 is electrically coupled with the body of the PMOS transistor 102.

The source electrode and the body of the NMOS transistor 101 are coupled with the ground terminal GND. The source electrode of the PMOS transistor 102 is coupled with the supply voltage terminal VDD. Two terminals of the resistance element R1 are each coupled with the drain electrode of the PMOS transistor 103 and the drain electrode of the PMOS transistor 102. The drain electrode of the PMOS transistor 103 is coupled with the body of the transistor of a functional circuit. Hence, a voltage VBP at the drain electrode of the PMOS transistor 103 is outputted and supplied to the functional circuit as a body bias voltage.

The gate electrode of the NMOS transistor 101 and the gate electrode of the PMOS transistor 102 receive an enable signal EN. A gate electrode of the PMOS transistor 103 receives an anti-enable signal ENB. The anti-enable signal ENB is an anti-phase signal of the enable signal EN.

Figure 2:
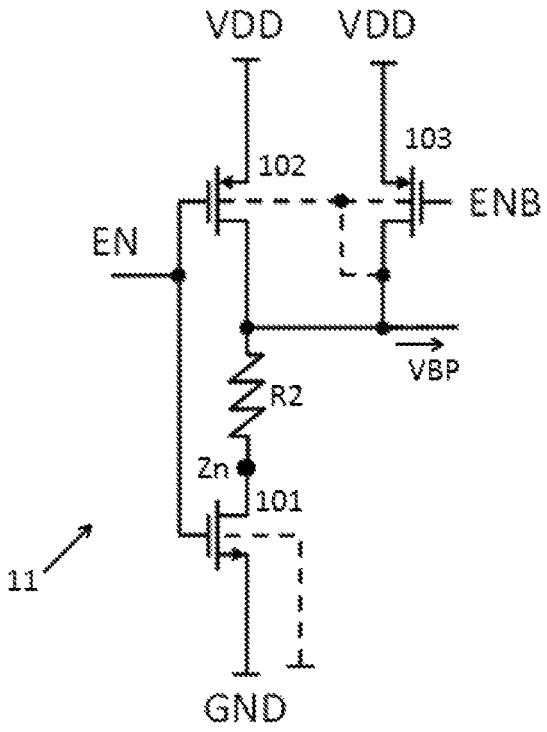
FIG. 2 is a circuit diagram illustrating a second embodiment of the body bias voltage generating circuit of the present disclosure.

Please refer to FIG. 2, which illustrates a circuit diagram of the second embodiment of the body bias voltage generating circuit of the present disclosure. The difference between the second embodiment and the above embodiment is the connection way of the resistant elements. In the embodiment of FIG. 2, the drain electrode of the PMOS transistor 103 and the drain electrode of the PMOS transistor 102 are electrically connected. Two terminals of the resistance element R2 are each coupled with the drain electrode of the PMOS transistor 103 and the drain electrode of the NMOS transistor 101, respectively.

Figure 3:
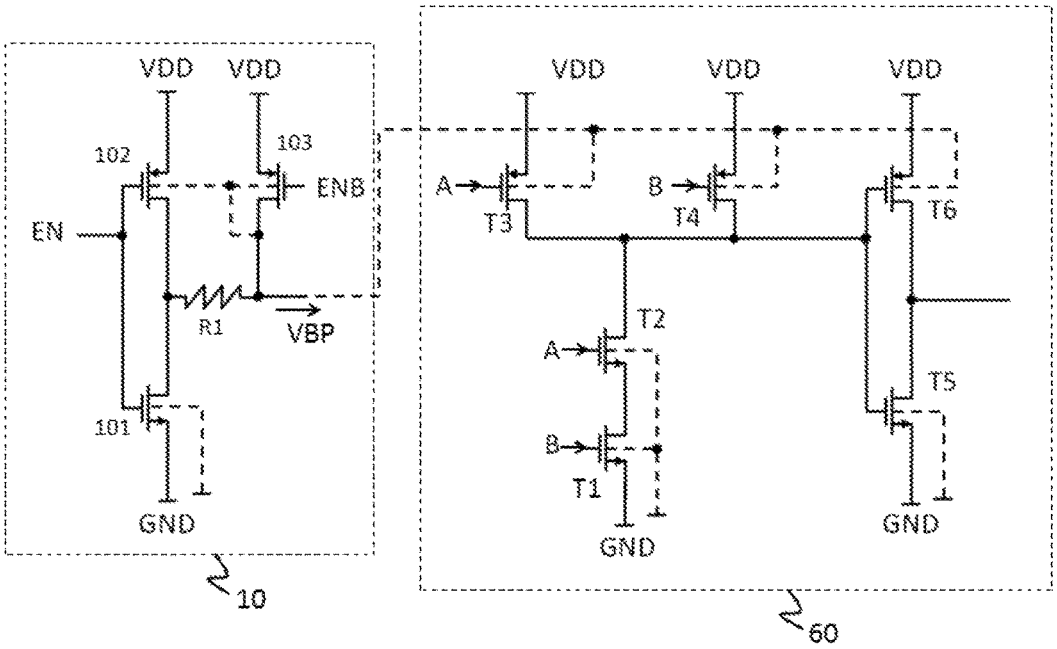
FIG. 3 is a schematic diagram illustrating a first embodiment of the body bias voltage generating circuit of the present disclosure applied in a functional circuit.
Figure 4:
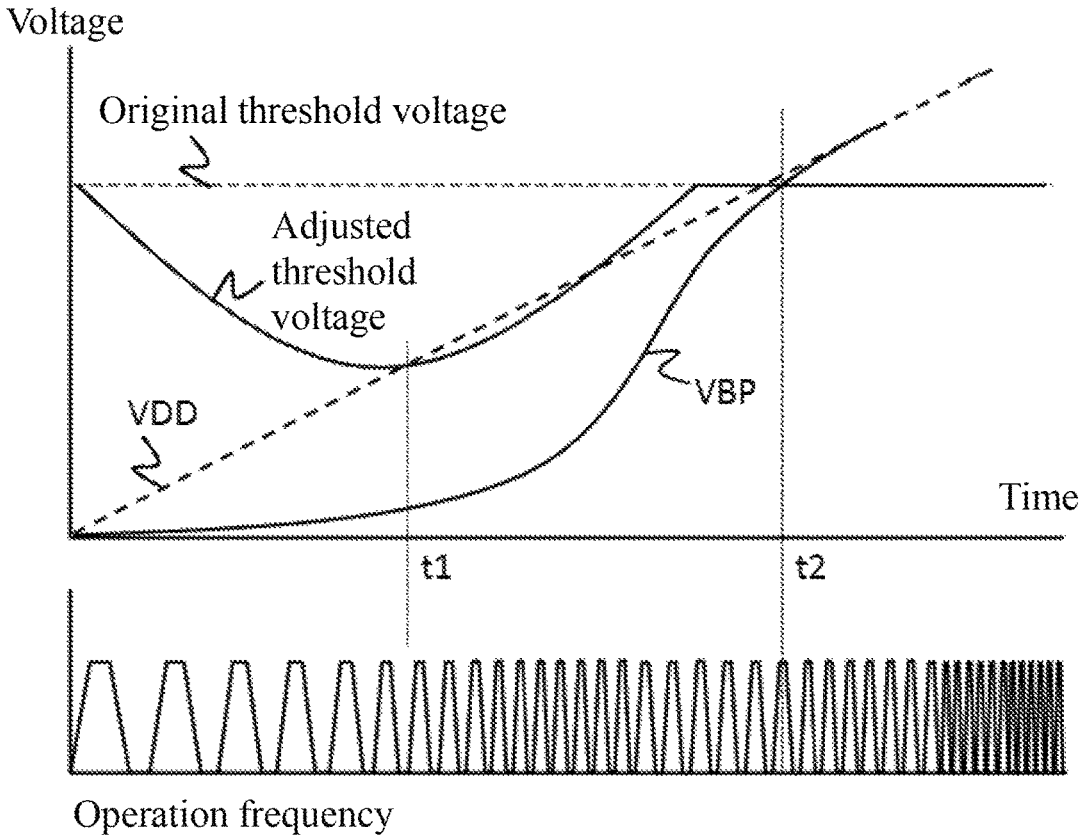
FIG. 4 is a voltage curve diagram illustrating a first embodiment of the body bias voltage generating circuit of the present disclosure applied in related signals of a functional circuit.

Please refer to FIGS. 3 and 4, which illustrate a schematic diagram illustrating the first embodiments of the body bias voltage generating circuit of the present disclosure applied in a functional circuit, and a voltage curve diagram of related signals. It has to be noticed that although a threshold voltage of the PMOS transistor is generally a negative value, for ease of realizing the embodiments, the original threshold voltage and the adjusted threshold voltage illustrated in FIG. 4 indicates a source-gate voltage of the PMOS transistor, thus they are positive values. However, this does not affects the comprehension of the body bias voltage generating circuit of the present disclosure by a person skilled in the art.

In FIG. 3, the functional circuit 60 is, only for instance but not limited to, a logical operation circuit, which is a combination of NAND circuit and a NOT circuit. In other embodiments, the functional circuit 60 may be any type of circuit. The body bias voltage generating circuit 10 outputs a body bias voltage VBP to bodies of the PMOS transistors T3, T4 and T6 of the functional circuit 60. Bodies of the NMOS transistors T1, T2 and T5 of the functional circuit 60 are coupled with the ground terminal GND.

Please then refer to FIG. 4, the curve "VDD" shows a voltage of the supply voltage terminal VDD raised from 0 V; the curve "VBP" shows a value of the body bias voltage VBP outputted from the body bias voltage generating circuit 10; the curve "original threshold voltage" shows a threshold voltage curve when the body of the transistor is connected with the source electrode of the same, of which the value is a fixed value. The curve "adjusted threshold voltage" shows that the threshold voltages of the PMOS transistors T3, T4 and T6 are varied based on the change of the body bias voltage VBP when the body bias voltage VBP is outputted to the bodies of PMOS transistors T3, T4 and T6.

When the enable signal EN is at a high level and the inverse-enable signal is at a low level, the NMOS transistor 101 is turned on, and the electric potential of end point Zn is 0. At the beginning, VDD is lower than the threshold voltage of the PMOS transistor 103 so that the PMOS transistor 103 is weakly turned on or is even at a cut-off state. Hence, the voltage across the resistance element R1 is related to the leakage current of the PMOS transistor 103. The leakage current of the PMOS transistor 103 flows through the resistance element R1, thus the body bias voltage VBP is proportional to the VDD, but it is almost equal to 0.

For instance, when VDD is too low, such as 0.3 V, the PMOS transistor 103 may be cut-off, and the body bias voltage VBP is almost equal to 0. The source electrodes of the PMOS transistors T3, T4 and T6 of the functional circuit 60 receive the VDD and the bodies thereof receive the body bias voltage VBP, so that the body bias voltage VBP sustaining at a voltage near to 0 and the VDD continuously rising may cause decreased adjusted threshold voltages of the PMOS transistors T3, T4 and T6, as shown in FIG. 4. The technique that aforementioned threshold voltages of the transistors may vary based on the change of the body bias voltage is omitted, since it is well-known by person skilled in related arts.

The operation may be accelerated by changing the body bias voltage VBP so that the PMOS transistors T3, T4 and T6 may be turned on early. As shown in FIG. 4, the body bias voltage VBP sustaining at a voltage near to 0 and the VDD continuously rising may cause decreased adjusted threshold voltages of the PMOS transistors T3, T4 and T6. Hence, the continuously rising VDD being larger than the adjusted threshold voltage at time point t1 causes the PMOS transistors T3, T4 and T6 being turned on. In contrast, if the bodies of the PMOS transistors T3, T4 and T6 are connected to the source electrodes thereof, the threshold voltage may be almost sustained at a fixed value, and the continuously raised VDD may be larger than the threshold voltage at time point t2, wherein the time point t1 is earlier than the time point t2.

After the PMOS transistors T3, T4 and T6 are turned on, the operation frequency thereof may become faster, as shown in the frequency diagram at the bottom of FIG. 4. As shown in the frequency diagram, when the VDD is lower that the threshold voltage, the functional circuit 60 may merely be operated at a lower frequency. When the adjusted threshold voltage is lower that the VDD, the functional circuit 60 may be operated at a higher frequency. Hence, the body bias voltage generating circuit of the present disclosure may make the functional circuit 60 being operated at a higher frequency earlier so as to improve the efficiency of the functional circuit 60.

When the VDD is larger than the threshold voltage, the PMOS transistor 103 may be fully turned on. Hence, the leakage current may be avoided when the body bias voltage VBP equals to the VDD so that the PMOS transistors T3, T4 and T6 of the functional circuit 60 restore back to a normal way of connection, that is, the electric potential of the source electrode is identical to that of the body. In addition, since the type of the PMOS transistor 103 is identical to and is manufactured by a same process as the PMOS transistors of the functional circuit 60 receiving a body bias voltage, the body bias voltage generating circuit may self-generate a voltage having an appropriate level at a same temperature condition, so the temperature effect and process effect may be omitted.

When an enable signal EN is at a low potential and an anti-enable signal ENB is at a high potential, the body bias voltage generating circuit 10 is turned off. When the enable signal EN is at a low level, the PMOS transistor 102 is turned on and the NMOS transistor 101 is turned off. Simultaneously, the anti-enable signal ENB is at a high potential, and the PMOS transistor 103 is turned off. Hence, the end point Zn is connected to the supply voltage terminal VDD through the PMOS transistor 102, that is, the body bias voltage VBP is the voltage of the supply voltage terminal VDD. Thus, when the body bias voltage generating circuit 10 is turned off, a route for leakage current may not be formed.

Aforementioned circuit operation processes are explained by the body bias voltage generating circuit 10. Similarly, the body bias voltage generating circuit 11 of FIG. 2 supplies the body bias voltage VBP to change the threshold voltage of transistors of a functional circuit by a same way, so the explanation is omitted here.

Figure 5:
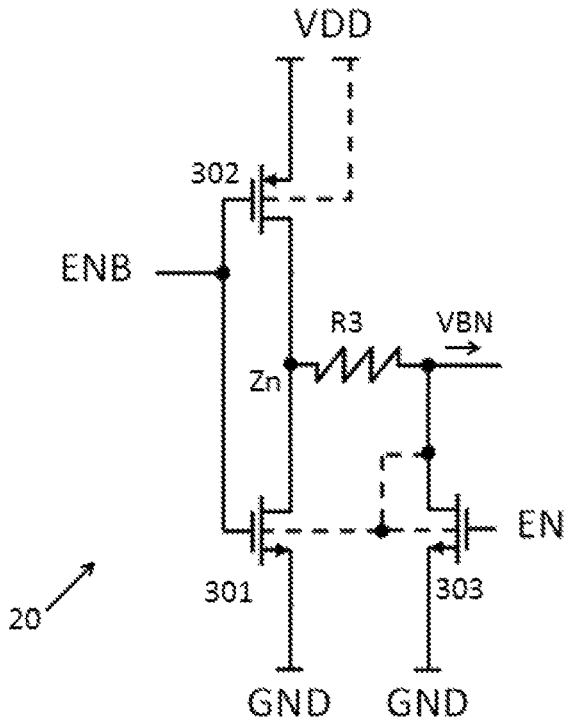
FIG. 5 is a circuit diagram illustrating a third embodiment of the body bias voltage generating circuit of the present disclosure.

Please refer to FIG. 5, which illustrates the circuit diagram of the body bias voltage generating circuit of the third embodiment of the present disclosure. In the figure, in the body bias voltage generating circuit 20, the first transistor is an NMOS transistor 301, the second transistor is a PMOS transistor 302, and a third transistor is an NMOS transistor 303, wherein the body of the NMOS transistor 303 is electrically coupled with the body of the NMOS transistor 301. The source electrode of the NMOS transistor 301 is coupled with the ground terminal GND. The source electrode and the body of the PMOS transistor are coupled with the supply voltage terminal VDD. Two terminals of the resistance element R3 are each coupled with the drain electrode of the NMOS transistor 303 and the drain electrode of the NMOS electrode 301, respectively. The drain electrode of the NMOS transistor 303 is coupled with the body of the transistors of the functional circuit. Thus, the voltage VBN at the drain electrode of the NMOS transistor 303 is outputted to supply as a body bias voltage to the functional circuit.

The gate electrode of the NMOS transistor 301 and the gate electrode of the PMOS transistor 302 receive an anti-enable signal ENB, whereas the gate electrode of the NMOS transistor 303 receives an enable signal EN. The anti-enable signal ENB is an anti-phase signal of the enable signal EN.

Figure 6:
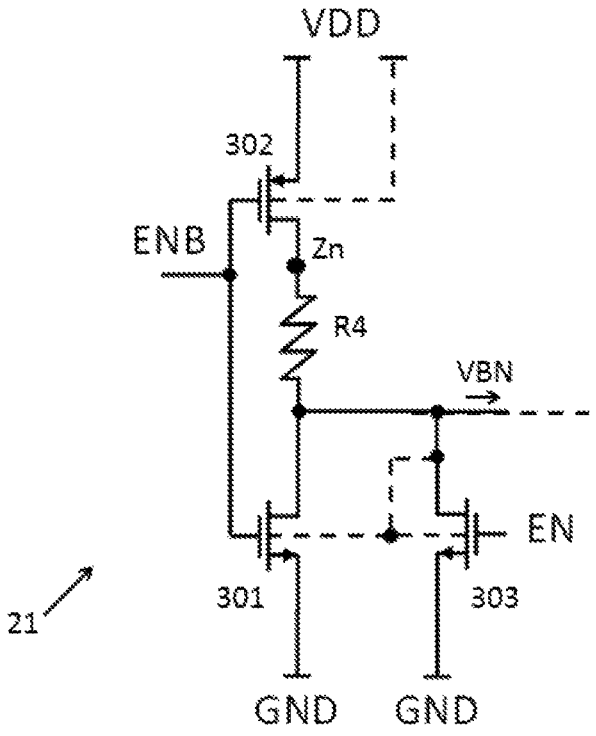
FIG. 6 is a circuit diagram illustrating a fourth embodiment of the body bias voltage generating circuit of the present disclosure.

Please refer to FIG. 6, which illustrates a circuit diagram of the body bias voltage generating circuit of the fourth embodiment of the present disclosure. The difference between the body bias voltage generating circuit 21 of the fourth embodiment and the third embodiment is the connection way of resistant elements. In the embodiment of FIG. 6, the drain electrode of the NMOS transistor 303 and the drain electrode of the NMOS transistor 301 are electrically coupled. The two sides of the resistance element R4 are each coupled to the drain electrode of the NMOS transistor 303 and the drain electrode of the PMOS transistor 302.

Figure 7:
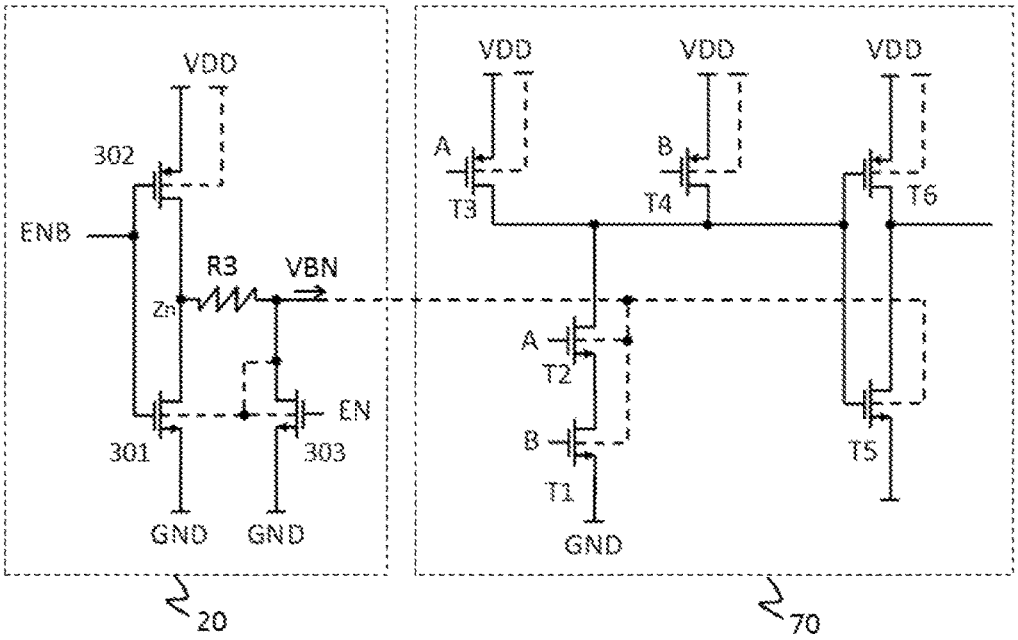
FIG. 7 is a schematic diagram illustrating a third embodiment of the body bias voltage generating circuit of the present disclosure applied in a functional circuit.
Figure 8:
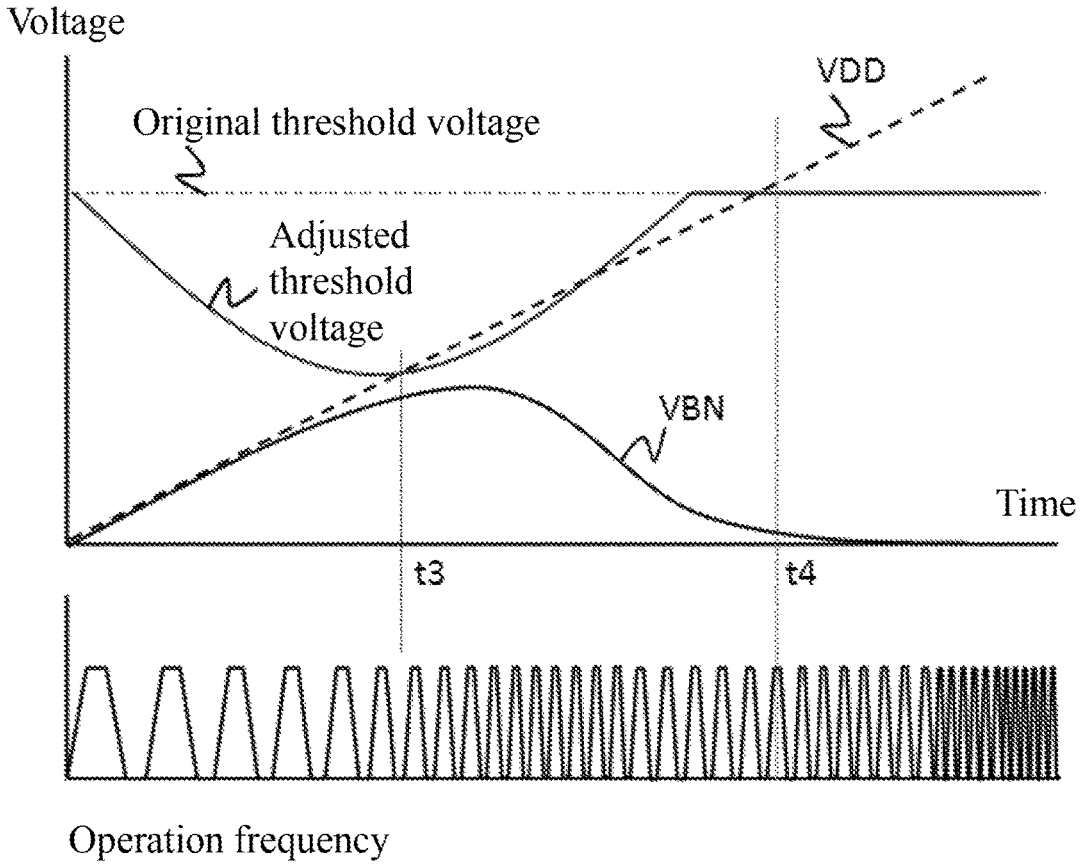
FIG. 8 is a voltage curve diagram illustrating a third embodiment of the body bias voltage generating circuit of the present disclosure applied in related signals of a functional circuit.

Please refer to FIGS. 7 and 8, which illustrate a schematic diagram illustrating the third embodiments of the body bias voltage generating circuit of the present disclosure applied in a functional circuit, and a voltage curve diagram of related signals. As shown in FIG. 7, the body bias voltage generating circuit 20 outputs the body bias voltage VBN to the bodies of the NMOS transistors T1, T2 and T5 of the functional circuit 70. When the enable signal EN is at a high level, the anti-enable signal ENB is at a low level, and the VDD is lower that the threshold voltage of the PMOS transistor 302, the PMOS transistor 302 is merely turned-on weakly or even is at a cut-off state. Hence, the voltage across the resistance element R3 is related to the leakage current of the PMOS transistor 303. Since the leakage current is very low, the body bias voltage VBN is almost equal to VDD. Since the source electrodes of the NMOS transistors T1, T2 and T5 of the functional circuit 70 are grounded as well as their bodies receive a body bias voltage VBN which is almost equal to VDD, the threshold voltages of the NMOS transistors T1, T2 and T5 are reduced. The continuously raised VDD at the time point t3 is larger than the adjusted threshold voltage, and the NMOS transistors T1, T2 and T5 are turned-on so that they may be operated by a higher frequency.

When the VDD continuously rising until larger than the threshold, the NMOS transistor 303 is completely turned-on. Hence, the body bias voltage is equal to 0, so that the NMOS transistors T1, T2 and T5 of the functional circuit 60 restore to a normal way of connection, that is, the electric potential of the source electrode is identical to that of the body. In addition, since the type of the NMOS transistor 303 is identical to and is manufactured by a same process as the NMOS transistors of the functional circuit 60 receiving a body bias voltage, the body bias voltage generating circuit of the present disclosure may self-generate a voltage having an appropriate level at a same temperature condition, so the temperature effect and process effect may be omitted.

When an enable signal EN is at a low potential and an anti-enable signal ENB is at a high potential, the body bias voltage generating circuit 20 is turned off. When the anti-enable signal ENB is at a high potential, the PMOS transistor 302 is turned off and the NMOS transistor 301 is turned-on. Simultaneously, the enable signal EN is at a low level, and the NMOS transistor 303 is cut-off. Hence the end point Zn is grounded through the NMOS transistor 301, that is, the body bias voltage VBN is 0. Thus, when the body bias voltage generating circuit 20 is turned off, a route for leakage current may not be formed.

Aforementioned circuit operation processes are explained by the body bias voltage generating circuit 20. Similarly, the body bias voltage generating circuit 21 of FIG. 6 supplies the body bias voltage VBN to change the threshold voltage of transistors of a functional circuit by a same way, so the explanation is omitted here.

Figure 9:
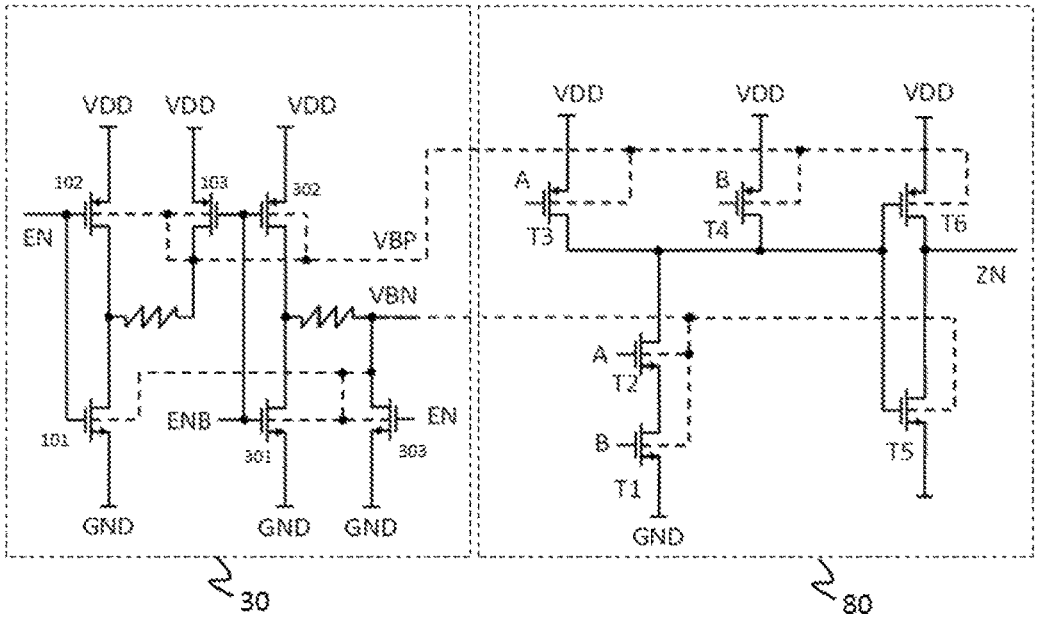
FIG. 9 is a schematic diagram illustrating a fifth embodiment of the body bias voltage generating circuit of the present disclosure applied in a functional circuit.

Please refer to FIG. 9, which illustrates the circuit diagram of the body bias voltage generating circuit of the fifth embodiment of the present disclosure. As shown in FIG. 9, the body bias voltage generating circuit 30 is a combination of the body bias voltage generating circuit 10 or the body bias voltage generating circuit 21 and the body bias voltage generating circuit 20 or the body bias voltage generating circuit 21. Hence, it may simultaneously, supply a body bias voltage VBP to the transistors T3, T4 and T6 of the functional circuit 80 and supply a body bias voltage VBN to the transistors T1, T2 and T5 of the functional circuit 80. The body bias voltage generating circuit 30 has a same operation mode as the above mentioned body bias voltage generating circuits, thus here the explanation thereof is omitted.

Figure 10:
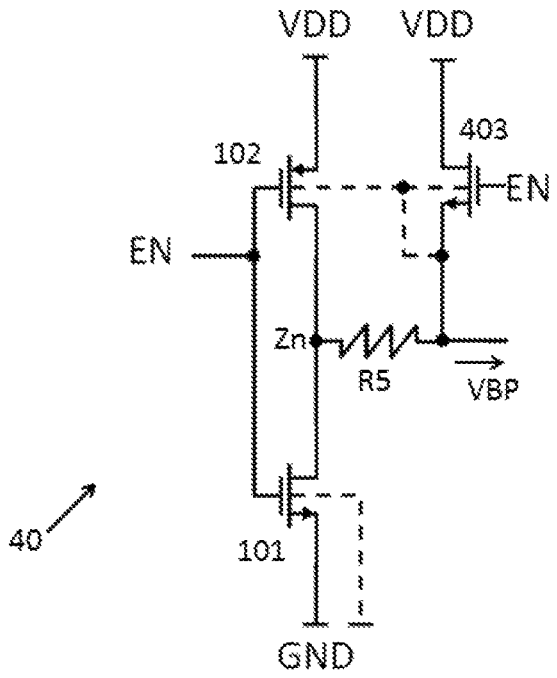
FIG. 10 is a circuit diagram illustrating a sixth embodiment of the body bias voltage generating circuit of the present disclosure.

Please refer to FIG. 10, which illustrates the circuit diagram of the body bias voltage generating circuit of the sixth embodiment of the present disclosure. The difference between the body bias voltage generating circuit 40 of the sixth embodiment and the first embodiment as shown in FIG. 1 is that the third transistor is achieved by an NMOS transistor 403. Further, the drain electrode of the NMOS transistor 403 is connected to the supply voltage terminal, and the source electrode and the body of the NMOS transistor 403 are connected to each other and electrically connected to one terminal of the resistance element R5. Furthermore, the gate electrode thereof receives an enable signal EN.

Figure 11:
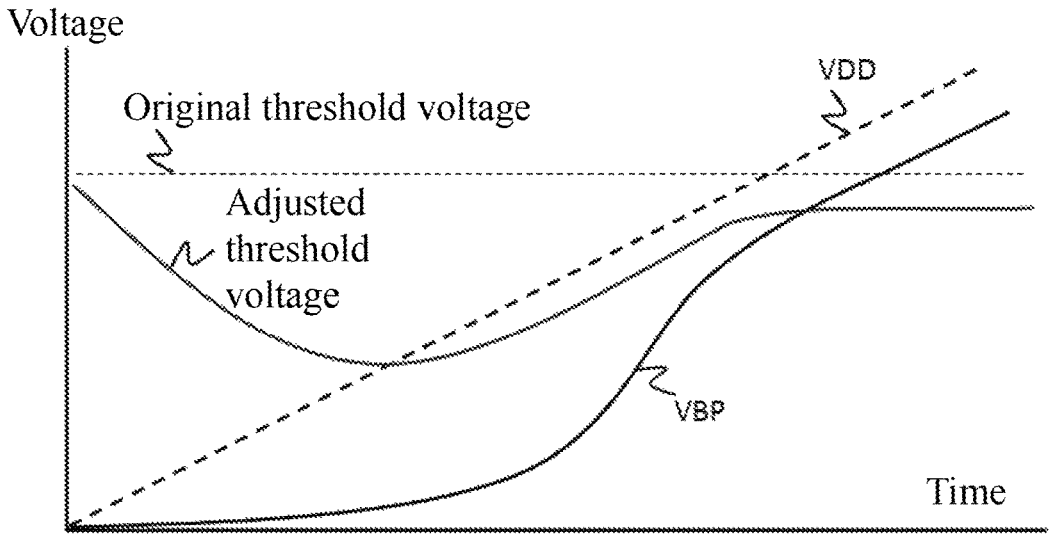
FIG. 11 is a voltage curve diagram illustrating a sixth embodiment of the body bias voltage generating circuit of the present disclosure applied in related signals of a functional circuit.

At a condition of that the functional circuit requires a larger P-type body driving capability, as well as that the body bias voltage generated by the body bias voltage generating circuit is applied to the P-type body of the P-type power transistor which has a larger area, the body bias voltage generating circuit 40 may be used for applying a body bias voltage. When an enable signal EN is high, the supply voltage VDD is rising from a low voltage, so the supply voltage VDD is lower than the threshold voltage of the NMOS transistor 403. Hence, the NMOS transistor 403 is merely turned-on weakly or even is at a cut-off state. Hence, the voltage across the resistance element R5 is related to the leakage current of the NMOS transistor 403. The difference between the body bias voltage generating circuit 40 and the body bias voltage generating circuit 10 is that, when the VDD is raised to a voltage higher than the threshold voltage of the NMOS transistor 403 (VTHN), the VBP is maintained at a voltage value of VDD-VTHN. As shown in FIG. 11, the VBP and VDD are briefly parallel to each other at the right half of the curve diagram and having a difference of the voltage value VTHN. Thus, a P-type body interface of the P-type transistor of the functional circuit may be continuously maintain with a body bias voltage to turn on the junction to achieve a maximum body bias driving capability.

It has to be noticed that, in the sixth embodiment, the third transistor is not limited as an NMOS transistor, but may also be replaced by a bipolar junction transistor (BJT) or a diode. When the third transistor is a BJT, the emitter of the BJT is coupled with one terminal of the resistance element R5. Further, the collector is coupled with a power supply terminal, and the base of the BJT is configured to accept the enable signal. When the third transistor is a diode, the cathode of the diode is connected to one terminal of the resistance element R5, whereas the anode is coupled with the power supply terminal. In the condition that the BJT or the diode is used in the sixth embodiment, the third transistor can also be called as a control element.

Figure 12:
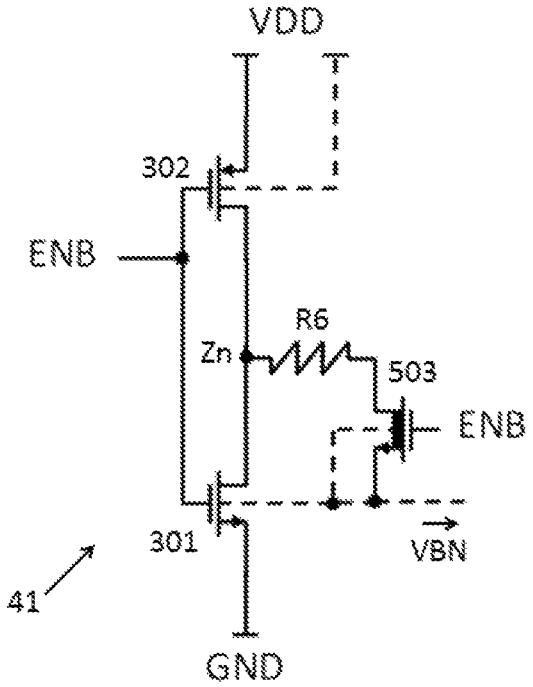
FIG. 12 is a circuit diagram illustrating a seventh embodiment of the body bias voltage generating circuit of the present disclosure.

Please refer to FIG. 12, which illustrates a circuit diagram of the seventh embodiment of the body bias voltage generating circuit of the present disclosure. The difference between the body bias voltage generating circuit 41 of the seventh embodiment and the third embodiment as shown in FIG. 5 is that the third transistor is achieved by a depletion-type NMOS transistor 503. The source electrode and the body of the depletion-type NMOS transistor 503 is electrically connected to the body of the NMOS transistor 301, whereas the drain electrode of the depletion-type NMOS transistor 503 is electrically connected to one terminal of the resistance element R6, and the gate electrode receives an anti-enable signal ENB.

Figure 13:
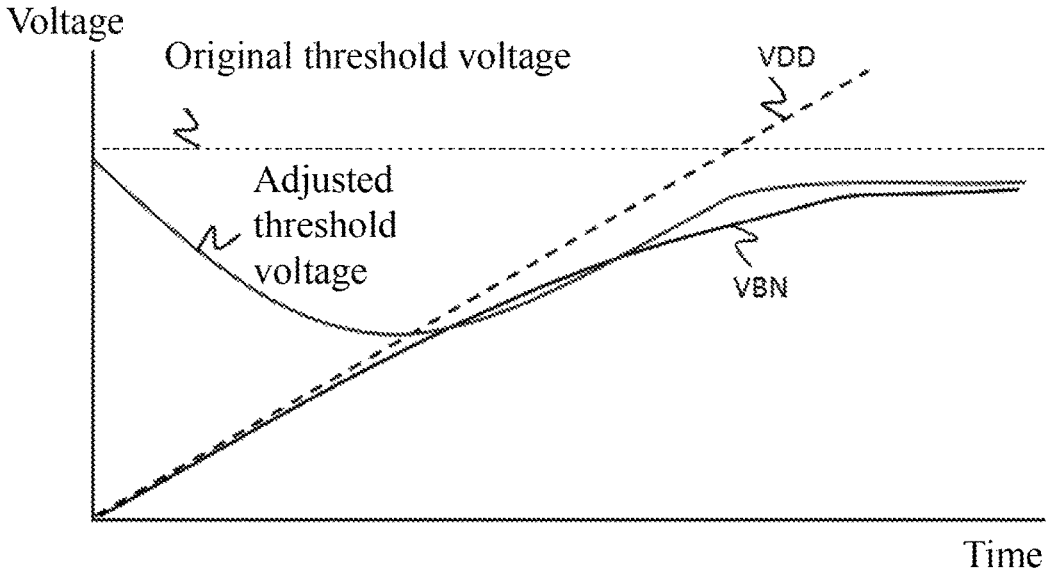
FIG. 13 is a voltage curve diagram illustrating a seventh embodiment of the body bias voltage generating circuit of the present disclosure applied in related signals of a functional circuit.

At a condition of that the functional circuit requires a larger N-type body driving capability, as well as that the body bias voltage generated by the body bias voltage generating circuit is applied to the N-type body of the N-type power transistor which has a larger area, the body bias voltage generating circuit 41 may be used for supplying a body bias voltage. As shown in FIG. 13, since the depletion-type NMOS transistor 503 is a normally-on device, when the enable signal EN is at a high level and the anti-enable signal ENB is at a low level as well as the VDD starts rising, the body bias voltage VBN may be briefly equal to a value of VDD minus the voltage across the resistance element R6. Thus, the N-type transistor of the functional circuit receives the body bias voltage to continuously maintain the pn junction being turned on so as to achieve a maximum body bias driving capability.

Figure 14:
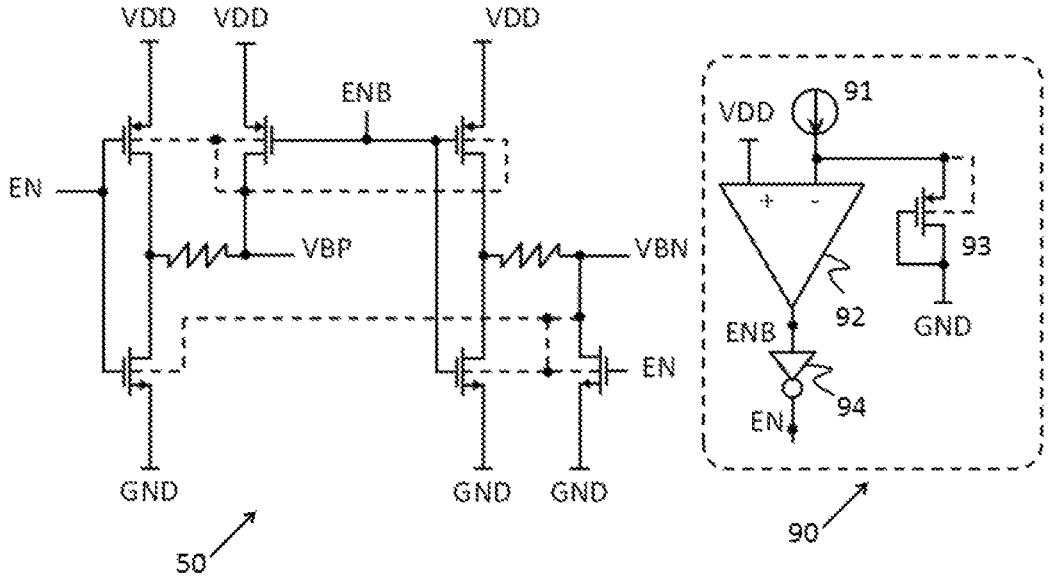
FIG. 14 is a circuit diagram illustrating an eighth embodiment of the body bias voltage generating circuit of the present disclosure.

Please refer to FIG. 14, which illustrates a circuit diagram of the seventh embodiment of the body bias voltage generating circuit of the present disclosure. The difference between the body bias voltage generating circuit 50 of the seventh embodiments and the aforementioned embodiments is that it further comprises a voltage detecting unit 90, which comprises a comparator 92, a current source 91, a PMOS transistor 93 and an inverter 94. The positive input terminal of the comparator 92 is electrically connected to the power supply terminal, whereas the negative input terminal is electrically connected to the current source 91 and the source electrode of the PMOS transistor 93, and the output terminal is connected to the input terminal of the inverter 94. The voltage at the output terminal of the comparator 92 is as an anti-enable signal ENB, whereas the voltage at the output terminal of the inverter 94 is as an enable signal EN.

When the voltage VDD at the power supply terminal is larger than the threshold voltage BTHP of the PMOS transistor 93, then the voltage at the output terminal of the comparator 92 changes from a low potential to a high potential so that the anti-enable signal ENB changes from a low potential to a high potential, and the enable signal EN changes from a high potential to a low potential in order to turn off the body bias voltage generating circuit 50.

It is to be understood that the present disclosure is not limited to the contents described above. Any equivalent modifications, variations and enhancements can be made thereto by those skilled in the art without changing the essential characteristics or technical spirit of the present disclosure, the technical and protective scope of which is defined by the following claims.

What is claimed is:

1. A body bias voltage generating circuit for supplying a body bias voltage to a body of a transistor of a functional circuit, the body bias voltage generating circuit comprising:

a first transistor and a second transistor connected in series between a supply voltage terminal and a ground terminal, wherein a control terminal of the first transistor is electrically coupled to a control terminal of the second transistor;

a third transistor, comprising a body electrically coupled to one of the bodies of the first transistor and the second transistor, and a terminal electrically coupled with the body thereof; and a resistance element electrically coupled between the terminal of the third transistor and a current input terminal of the first transistor or a current output terminal of the second transistor;

wherein the voltage at the terminal of the third transistor is the body bias voltage.

2. The body bias voltage generating circuit as claimed in claim 1, wherein the first transistor is an NMOS transistor, the second transistor is a PMOS transistor, and the third transistor is a PMOS transistor, the terminal of the third transistor is a drain electrode, the body of the third transistor is electrically coupled with the body of the second transistor and the drain electrode of the third transistor, a source electrode and the body of the first transistor is coupled with the ground terminal, and a source electrode of the second transistor is coupled with the supply voltage terminal.

3. The body bias voltage generating circuit as claimed in claim 2, wherein two terminals of the resistance element are each coupled with the drain electrode of the third transistor and the drain electrode of the second transistor, respectively.

4. The body bias voltage generating circuit as claimed in claim 2, wherein the drain electrode of the third transistor and the drain electrode of the second transistor are electrically connected, and two terminals of the resistance element are each coupled with the drain electrode of the third transistor and a drain electrode of the first transistor.

5. The body bias voltage generating circuit as claimed in claim 1, wherein the first transistor is an NMOS transistor, the second transistor is a PMOS transistor, and the third transistor is an NMOS transistor, the terminal of the third transistor is a drain electrode, the body of the third transistor is electrically coupled with the body of the first transistor and the drain electrode of the third transistor, a source electrode of the first transistor is coupled with the ground terminal, and a source electrode and the body of the second transistor is coupled with the supply voltage terminal.

6. The body bias voltage generating circuit as claimed in claim 5, wherein two terminals of the resistance element are each coupled with the drain electrode of the third transistor and a drain electrode of the first transistor, respectively.

7. The body bias voltage generating circuit as claimed in claim 5, wherein the drain electrode of the third transistor and a drain electrode of the first transistor are electrically coupled, and two terminals of the resistance element are each coupled with the drain electrode of the third transistor and a drain electrode of the second transistor, respectively.

8. The body bias voltage generating circuit as claimed in claim 1, wherein the control terminal of the first transistor and the control terminal of the second terminal receive an enable signal; and a control terminal of the third transistor receives an anti-enable signal, the anti-enable signal is an anti-phase signal of the enable signal.

9. The body bias voltage generating circuit as claimed in claim 1, wherein the first transistor is an NMOS transistor, the second transistor is a PMOS transistor, and the third transistor is an NMOS transistor;

wherein the terminal of the third transistor is a drain electrode of the NMOS transistor of the third transistor wherein the NMOS transistor of the third transistor is a depletion type NMOS transistor.

10. A body bias voltage generating circuit for supplying a body bias voltage to a body of a transistor of a functional circuit, the body bias voltage generating circuit comprising:

a first transistor and a second transistor connected in series between a supply voltage terminal and a ground terminal, wherein a control terminal of the first transistor is electrically coupled to a control terminal of the second transistor;

a control element comprising a terminal electrically coupled to one of the bodies of the first transistor and the second transistor, and other terminal electrically coupled the supply voltage terminal; and a resistance element electrically coupled between the terminal of the control element and a current input terminal of the first transistor or a current output terminal of the second transistor;

wherein the voltage at the terminal of the control element is the body bias voltage.

11. A body bias voltage generating circuit for supplying a body bias voltage to a body of a transistor of a functional circuit, the body bias voltage generating circuit comprising:

an NMOS transistor and a PMOS transistor connected in series between a supply voltage terminal and a ground terminal, a gate electrode of the NMOS transistor being coupled with a gate electrode of the PMOS transistor;

a depletion type NMOS transistor, a body of the depletion type NMOS transistor being electrically coupled with the body of the NMOS transistor, a source electrode and the body of the depletion type NMOS transistor being electrically connected; and a resistance element coupled between a drain electrode of the depletion type NMOS transistor and a drain electrode of the NMOS transistor;

wherein a voltage at the source electrode of the depletion type NMOS transistor is the body bias voltage.

* * * * *